US006778048B1

(12) United States Patent
Brignoni et al.

(10) Patent No.: US 6,778,048 B1
(45) Date of Patent: Aug. 17, 2004

(54) CIRCUIT BREAKER INTERFACE MECHANISM FOR BELL ALARM SWITCH

(75) Inventors: Luis Brignoni, Toa Baja, PR (US); Ronald Ciarcia, Bristol, CT (US); Ananthram Subramanian, Secunderabad (IN); Narender Macha, Chikkadapally (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/249,860

(22) Filed: May 13, 2003

(51) Int. Cl.[7] ..... H01H 67/02

(52) U.S. Cl. ..... 335/132; 335/202; 335/17; 335/172

(58) Field of Search ..... 335/132, 202, 335/166–176, 17, 23–25; 200/293–308

(56) References Cited

U.S. PATENT DOCUMENTS 5,036,303 A * 7/1991 Papallo et al. ..... 335/17
5,140,115 A * 8/1992 Morris ..... 200/308
5,172,088 A * 12/1992 Morgan ..... 335/201
6,114,641 A 9/2000 Castonguay et al.
6,175,288 B1 1/2001 Castonguay et al. ..... 335/16
6,218,919 B1 4/2001 Ciarcia et al. ..... 335/167
6,396,369 B1 5/2002 Schlitz et al. ..... 335/16
6,600,396 B1 * 7/2003 Rodriguez et al. ..... 335/132

* cited by examiner

*Primary Examiner*—Lincoln Donovan
(74) *Attorney, Agent, or Firm*—Cantor Colburn LLP

(57) ABSTRACT

An assembly for interacting with a circuit breaker operating mechanism of a circuit breaker including a housing and a pair of contacts within the housing, the operating mechanism arranged to separate the pair of contacts upon the occurrence of a trip event is disclosed. The assembly includes a plurality of linkages arranged to transmit mechanical energy from the operating mechanism to a plunger of an accessory device for changing a state thereof. The system of linkages is configured to compensate for any over-travel resulting from possible tolerance variations.

23 Claims, 7 Drawing Sheets

Tripped

CIRCUIT BREAKER INTERFACE MECHANISM FOR BELL ALARM SWITCH

BACKGROUND OF THE INVENTION

This invention relates to circuit breakers, and, more particularly to a circuit breaker interface mechanism for a bell alarm switch.

It is generally well known in the art of circuit breakers to provide a reset mechanism to reset a tripping device such as an accessory shunt trip or under voltage device. During quiescent operation, (i.e. when the circuit breaker contacts are closed to allow the flow of electrical current) the operating handle of an operating mechanism is in the "ON" position. To stop the current flow manually, the handle may be shifted to the "OFF" position thereby opening the electrical contacts. Upon attainment of a pre-determined condition (trip event), such as ground fault or overload, the operating mechanism of the circuit breaker will release the forces of the mechanism operating springs and release the operating handle to a tripped position between the "ON" position and the "OFF" position. Before the circuit breaker may be turned "ON", the operating mechanism must be manually reset. This is accomplished by rotating the operating handle beyond the "OFF" position against the bias of the operating mechanism springs, thereby locking the operating mechanism in position.

The same mechanical forces used to direct the operating mechanism from the tripped position to the reset position are used to reset any attached accessories, such as a shunt trip actuator, auxiliary switch accessory, bell alarm or other type of accessory unit. However, as accessories are generally separate components mounted proximate to the operating mechanism, positional variations at the interface of the accessory and the circuit breaker operating mechanism are possible due to manufacturing tolerances. These positional variations can affect the resetting motion translated to the bell alarm switch or its components by not compensating for any over-travel resulting from the possible tolerance variations. Furthermore, a reliable interface mechanism between the circuit breaker and internal accessories is desired that will provide reliable actuation of the bell alarm switch when the breaker changes state in either an overload "trip" condition or when a push-to-trip button is depressed without robbing energy from the operating mechanism during such tripping operation, which is common with conventional accessory interface systems. Conventional accessory interface systems between the operating mechanism and accessories presently rely only on limited "take up" provided by the accessory switch. It is further desired that the switch also be field installable by the customer without violating UL requirements.

BRIEF DESCRIPTION OF THE INVENTION

The above discussed and other drawbacks and deficiencies of the prior art are overcome or alleviated by an assembly for interacting with a circuit breaker operating mechanism of a circuit breaker including a housing and a pair of contacts within the housing, the operating mechanism arranged to separate the pair of contacts upon the occurrence of a trip event. The assembly includes a plurality of linkages arranged to transmit mechanical energy from the operating mechanism to a plunger of an accessory device for changing a state thereof. The system of linkages is configured to compensate for any over-travel resulting from possible tolerance variations.

In an exemplary embodiment of the invention, an assembly for interacting with a circuit breaker operating mechanism of a circuit breaker, the assembly includes an accessory device disposed in the housing including a plunger configured for movement between a retracted position and a protruded position. A cradle pivot pin having operable communication with the operating mechanism is further in mechanical cooperation with a first link that in turn is in mechanical cooperation with a second link. The first link and cradle pivot pin are complimentary configured such that the first link receives the cradle pivot pin therein and rotation relative to each other is prevented. The second link is in further mechanical cooperation with the plunger. When the operating mechanism applies a force to the cradle pivot pin, the force changes a state of the accessory device by being transmitted from the operating mechanism to the cradle pivot pin, from the cradle pivot pin to the first link, from the first link to the second link, and from the second link to the plunger for changing a position of the plunger from either the protruded position or the retracted position.

BRIEF DESCRIPTION OF THE DRAWINGS

Referring now to the drawings wherein like elements are numbered alike in the several FIGURES.

DETAILED DESCRIPTION OF THE INVENTION

Figure 1:
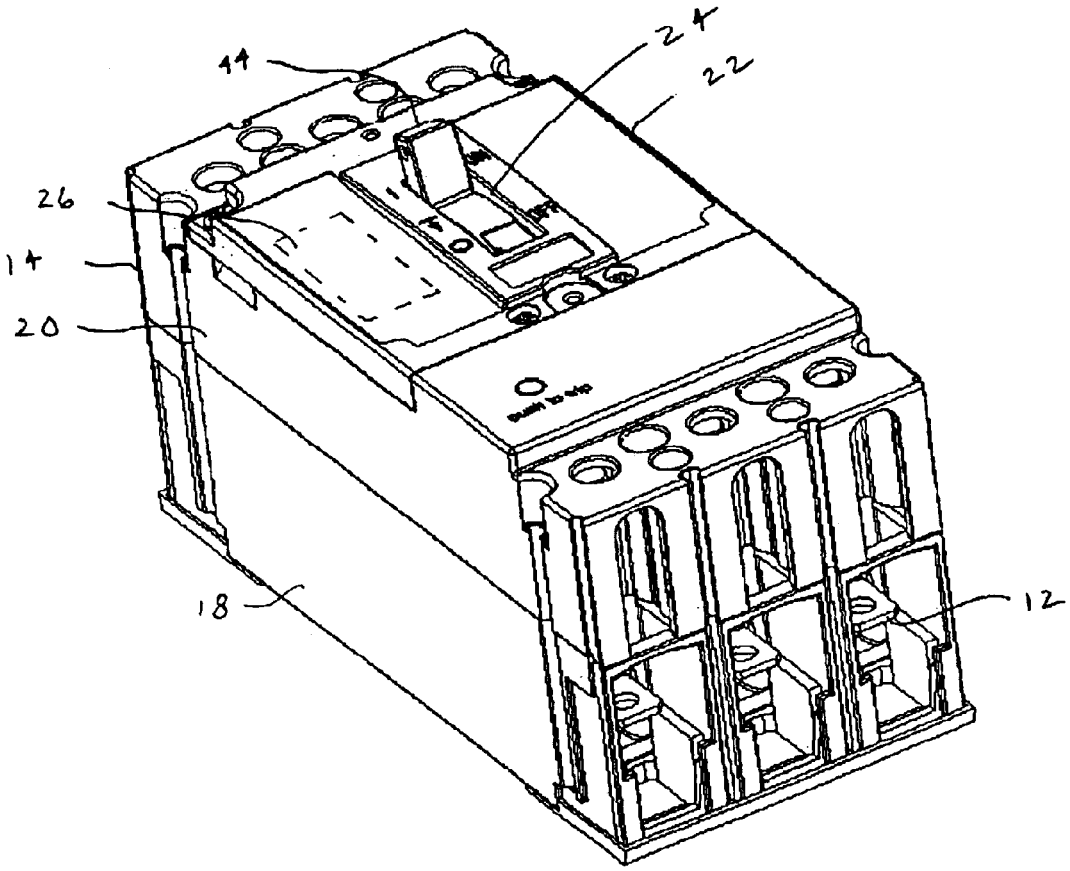
FIG. 1 is a top perspective view of a molded case circuit breaker.

Referring to FIG. 1, a top perspective view of a molded case circuit breaker 10 is generally shown. Molded case circuit breaker 10 is generally interconnected within a protected circuit between multiple phases of a power source (not shown) at line end 14 and a load to be protected (not shown) at load end 12. Molded case circuit breaker 10 includes a base 18, a mid cover 20 and a top cover 22 having a toggle handle 44 (operating handle) extending through an opening 24. Toggle handle 44 is interconnected with a circuit breaker operating mechanism 38 (FIG. 2) and allows for external operation of cassettes 32, 34 and 36. A switch (e.g., a bell alarm switch) 26 is positioned within the mid cover 20 as shown in phantom, and interfaces with circuit breaker operating mechanism 38. In an exemplary embodiment, the switch 26 is a bell alarm switch (switch), however, other auxiliary switch accessories are contemplated.

Figure 2:
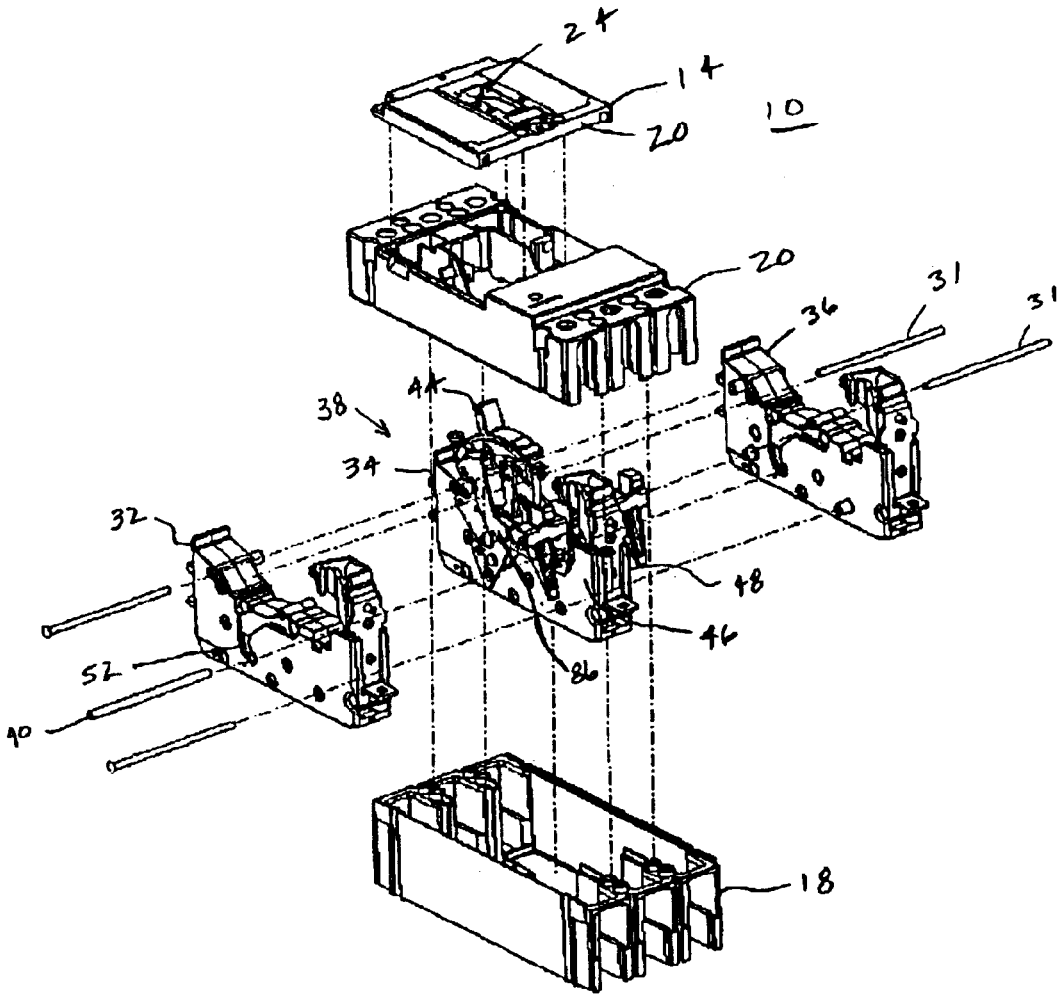
FIG. 2 is an exploded perspective view of a molded case circuit breaker.

Referring now to FIG. 2, an exploded view of molded case circuit breaker 10 is provided. A series of circuit breaker cassettes 32, 34, 36 are generally well known and may be, for example, of the rotary type. Examples of rotary contact structures that may be operated by operating mechanism 38 are described in more detail in U.S. Pat. Nos. 6,114,641 and 6,396,369, both entitled "Rotary Contact Assembly For High-Ampere Rated Circuit Breakers", and U.S. Pat. No. 6,175,288, entitled "Supplemental Trip Unit For Rotary Circuit Interrupters".

Circuit breaker cassettes 32, 34, 36 are seated approximately upstanding within base 18, and the cassette 34 includes operating mechanism 38 positioned thereon. The individual phases of current are divided into three phases, wherein each phase passes through one of the circuit breaker cassettes 32, 34, 36. Each of cassettes 32, 34, 36 includes one or more contact pairs therein for passage of current when the contacts are closed and for preventing passage of current when the contact pairs are opened. It is contemplated that the number of phases, or specific type of cassette utilized, can vary according to factors including, but not limited to, the type of load circuit being protected and the type of line input being provided to the circuit breaker 10.

Still referring to FIG. 2, each cassette 32, 34, 36 is commonly operated by a first cross bar (cross pin) 40 that interfaces with the internal mechanisms of cassettes 32, 34, 36 such that when one of cassettes 32, 34, 36 are opened or closed, the other cassettes 32, 34, 36 will operate cooperatively. It will be recognized by one skilled in the pertinent art that only one cross bar may be used to interface with the internal mechanisms of cassettes 32, 34, 36 such that when one of cassettes 32, 34, 36 are opened or closed, the other cassettes 32, 34, 36 will operate cooperatively. Positioning rods 31 are also employed to position the cassettes 32, 34, 36 adjacent to each other. Operating mechanism 38 is positioned and configured atop cassette 34, which is generally disposed intermediate to cassettes 32 and 36. Operating mechanism 38 operates substantially as described herein and as described in U.S. Pat. No. 6,218,919, entitled "Circuit Breaker Latch Mechanism with Decreased Trip Time". It should also be noted that employment of other operating mechanisms is contemplated, as well. The cassettes 32, 34, 36 are typically formed of high strength plastic material and each include opposing sidewalls.

Figure 3:
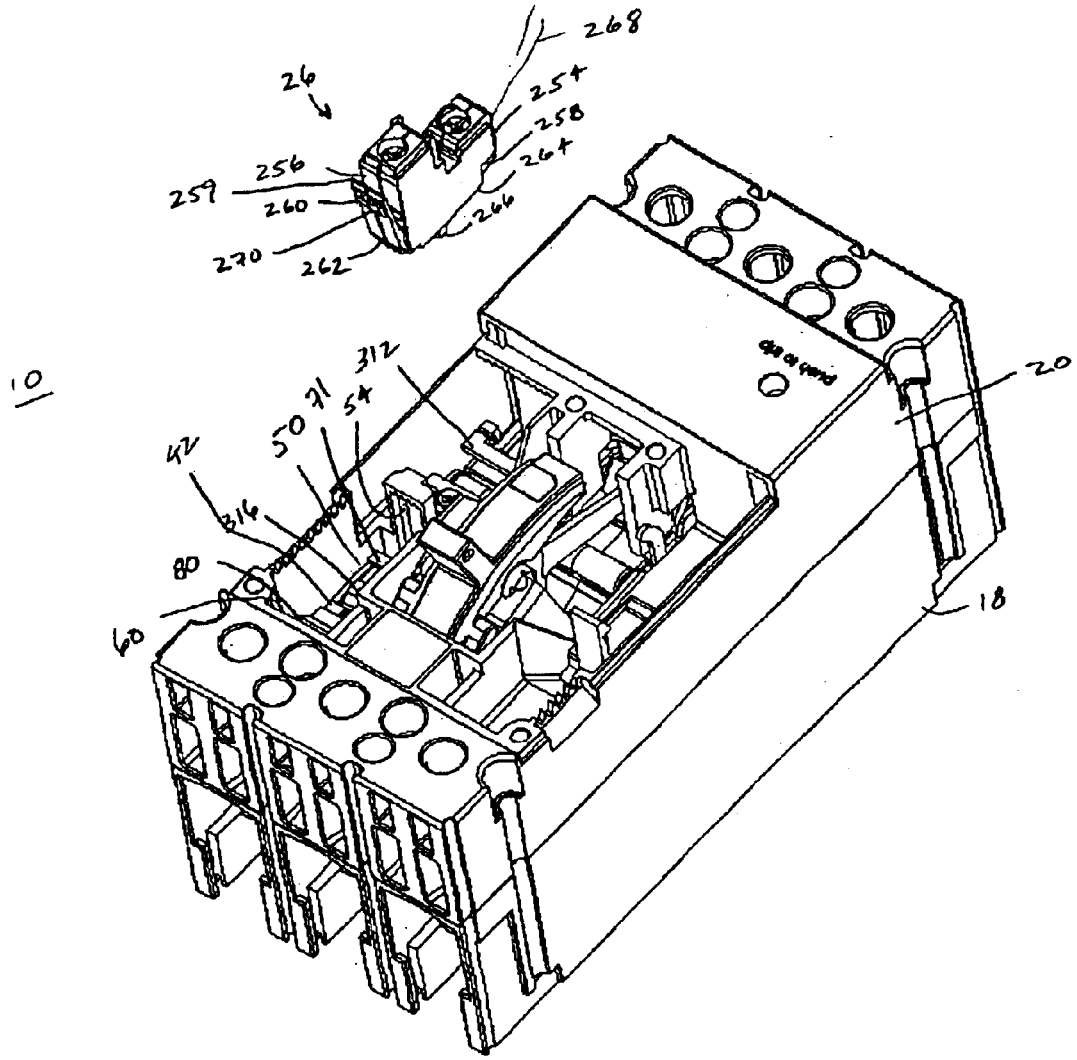
FIG. 3 is a side perspective view of the circuit breaker of FIG. 2 with the top cover removed and an actuator and an auxiliary switch in an assembly view.

Referring to FIG. 3, an isometric view of the circuit breaker 10 is shown, showing switch 26 and a portion of an interface mechanism or actuator shown generally at 42 in an exploded view with the top cover 22 (FIG. 1) removed. The switch 26 is shown removed from a cavity 50 located within the mid cover 20 for clarity.

The cavity 50 is formed integral with the mid cover 20 and comprises a front mounting surface 54, a rear mounting surface 60. The bottom surface of the cavity 50 is perpendicular to the front and rear mounting surfaces 54, 60. Located within the rear mounting surface 60 is a shelf 71 and located within the front mounting surface 54 is a shelf 80. The shelf 80 and the shelf 71 are integrally molded within the cavity 50.

The switch 26 (e.g., a bell alarm switch) is mounted within cavity 50 located within the mid cover 20. The switch 26 comprises a front surface 254 and a rear surface 256 and a connecting bottom surface 264. The front surface 254 having a tab 258 disposed thereon. Extending upward from the rear surface 256 is a mounting prong 260. A first end 262 of the mounting prong 260 is attached to the switch 26 at a point just above the bottom surface 264. The mounting prong 260 is thin and flexible in comparison with the switch 26. The mounting prong 260 extends upward from the first end 262, it angles slightly away from the rear surface 256 of the switch 26. A second end 259 of the mounting prong 260 is separated a distance from the rear surface 256 of the switch 26.

The switch 26 also includes a push button plunger (plunger) 266 that is spring mounted from the bottom surface 264 of the switch 26. The plunger 266 is spring loaded to permit the plunger 266 to be depressed closing contacts within the switch 26 and also to be released back outward opening the contacts within the switch 26. It is also contemplated that switch 26 is alternatively configured such that when plunger 266 is depressed, the contacts may be opened instead of closed. However, in either case, depressing plunger 266 changes a state indicated by switch 26 and protrusion of the plunger provides for an opposite change of state. When the switch 26 is installed within the cavity 50 as described herein below, the plunger 266 extends downward and is positioned to align with an arm or compliant member shown generally at 316. The switch 26 may then be connected with a remote bell alarm, for example, by means of a pair of wires 268 that extend from the switch 26.

The switch 26 is installed into the cavity 50 by the end user. When installing the switch 26 into the cavity 50, the tab 258 of the switch 26 is arranged so as to be inserted under the shelf 71. Then, the mounting prong 260 is flexed so that a tab 270 on the mounting prong 260 can snap into place under the shelf 80. Thus, the switch 26 is held in position within the cavity 50 by the interaction of the tab 258 and the mounting prong 260 of the switch 26 with the shelf 71 and shelf 80, respectively. When the switch 26 is installed in the mid cover 20 of the circuit breaker 10, the plunger 266 aligns with and is located proximate to the arm or compliant member 316 of the interface mechanism as detailed more fully below.

Figure 5:
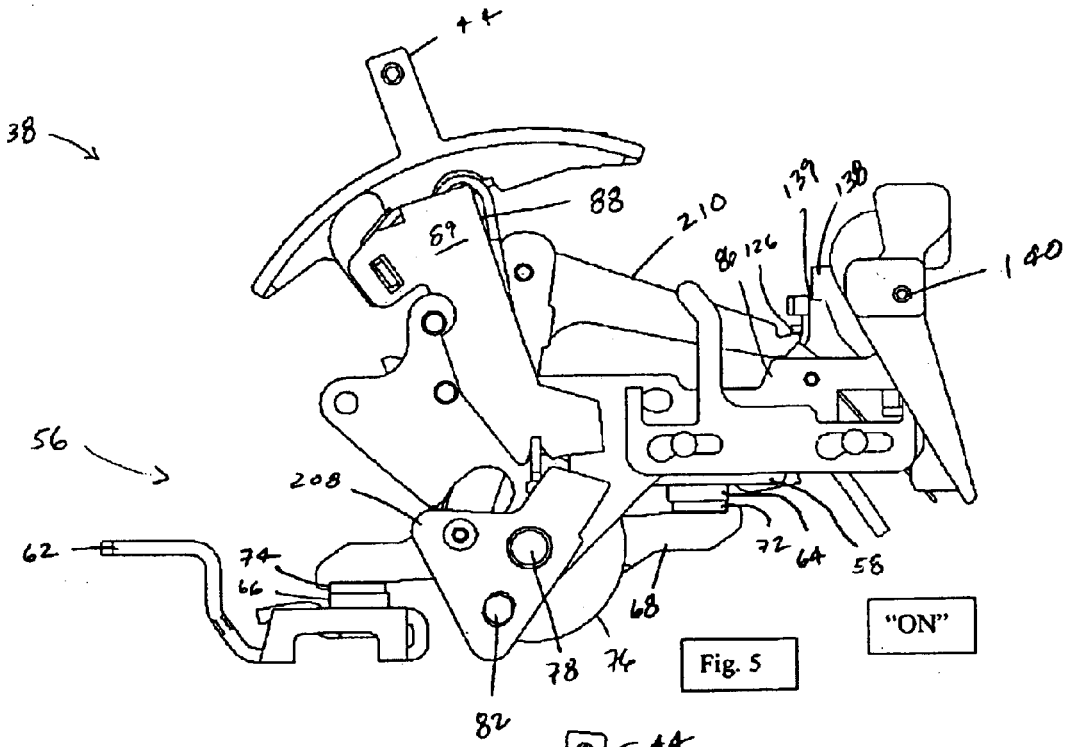
FIG. 5 is a partial sectional view of the rotary contact structure and operating mechanism of FIG. 3 in the "on" position.
Figure 4:
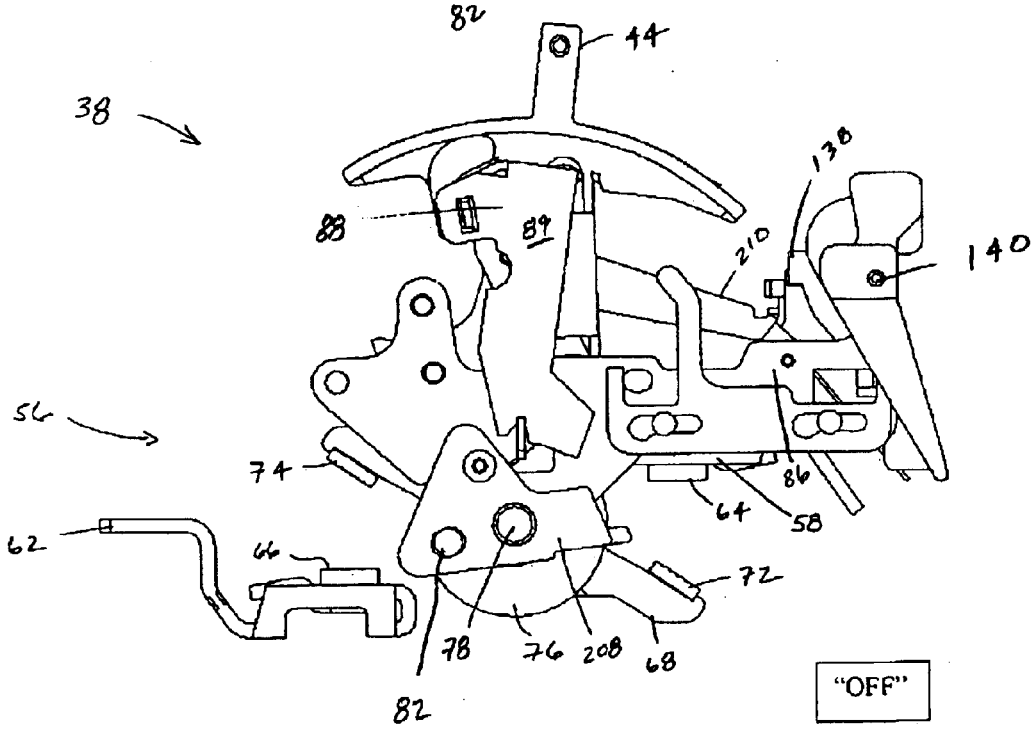
FIG. 4 is a partial sectional view of a rotary contact structure and operating mechanism embodied by the present invention in the "off" position.
Figure 6:
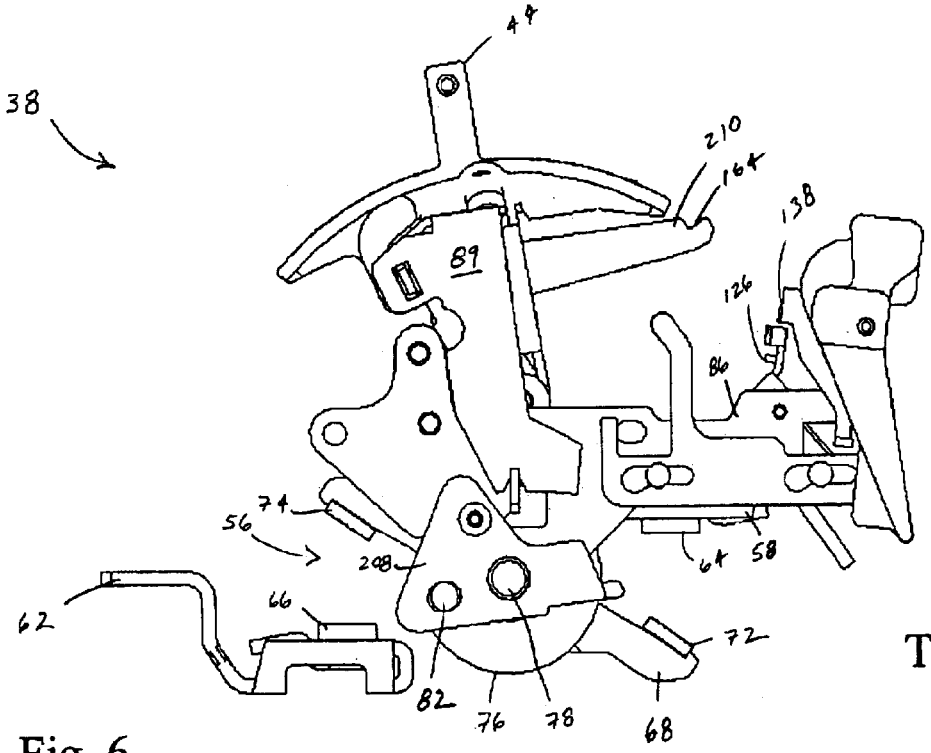
FIG. 6 is a partial sectional view of the rotary contact structure and operating mechanism of FIGS. 3 and 4 in the "tripped" position.

Referring now to FIGS. 4, 5, and 6, the operating mechanism 38 will now be detailed. An exemplary rotary contact assembly 56 is shown disposed within each cassette 32, 34, 36 and shown in the "off", "on" and "tripped" conditions, respectively. Also depicted are partial side views of operating mechanism 38, the components of which are described in greater detail further herein. Rotary contact assembly 56 includes a load side contact strap 58 and line side contact strap 62 for connection with a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 4) of operating mechanism 38, wherein toggle handle 44 is oriented slightly off center to the right (e.g., via a manual or mechanical force), contacts 72 and 74 are separated from stationary contacts 64 and 66, thereby preventing current from flowing through contact arm 68.

In the "on" position (FIG. 5) of operating mechanism 38, wherein toggle handle 44 is oriented to the left as depicted in FIG. 4 (e.g., via a manual or mechanical force), contacts 72 and 74 are mated with stationary contacts 64 and 66, thereby allowing current to flow through contact arm 68. In the "tripped" position (FIG. 6) of operating mechanism 38, toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must-ultimately be returned to the "on" position for operation. This is effectuated by applying a reset force to move toggle handle 44 to a "reset" condition, which is beyond the "off" position (i.e., further to the left of the "off" position in FIG. 4), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 7:
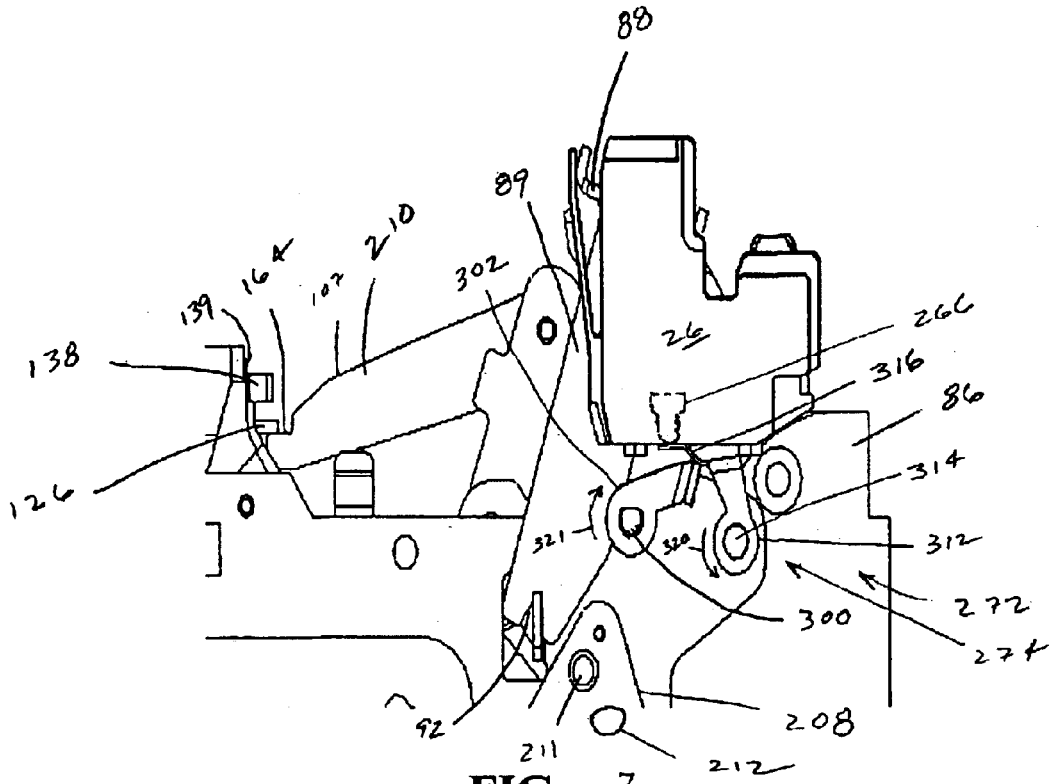
FIG. 7 is a side view of the operating mechanism in a reset position and the auxiliary, switch in an inactivated position.
Figure 8:
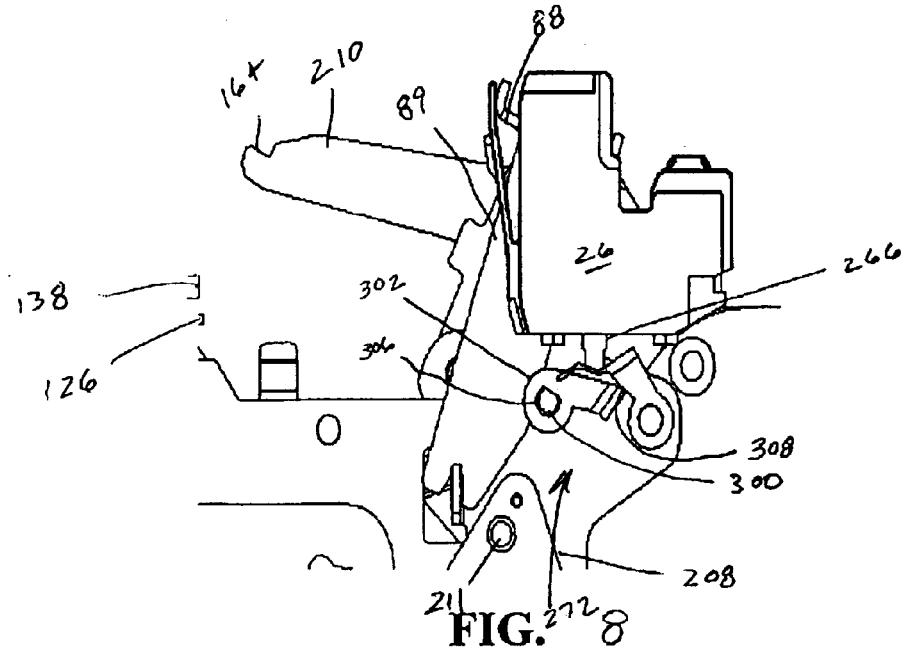
FIG. 8 is a side view of the operating mechanism in a trip position and the auxiliary switch in an activated position.

Referring now to FIGS. 7 and 8, the components of operating mechanism 38 will now be detailed in relation to interfacing with switch 26. As viewed in FIG. 7, operating mechanism 38 is in the closed or "on" position after being reset. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions (only one shown) 89. Each side portion 89 includes a U-shaped portion 92 at the bottom portion of each side portion 89. U-shaped portions 92 are rotatably positioned on a pair of bearing portions (not shown) protruding outwardly from side frames 86.

Operating mechanism 38 has a pair of cranks 208 operably connected to a cradle 210. Examples of rotary contact structures having such a cradle that may be operated by operating mechanism 38 are described in more detail in U.S. patent application Ser. No. 09/795,017. Each crank 208 pivots about a center 78. Crank 208 has an opening 212 where a cross pin 40 (FIG. 2) passes through into arcuate passage 52 of cassettes 32, 34 and 36 (FIG. 2).

Still referring to FIG. 7, cradle 210 is disposed adjacent to corresponding side frames 86 and pivots with respect to a cradle pivot pin 300 disposed through a corresponding opening (not shown) disposed in cradle 210. Cradle 210 includes a top edge surface 107 including a cradle latch surface 164 disposed at one end thereof.

A primary latch 126 is positioned within side frame 86. A secondary latch 138 is pivotally positioned within side frames 86. Secondary latch 138 extends from operating mechanism 38 as to allow an interface with, for example, a shunt trip (not shown), or a thermal magnetic trip unit (not shown) to release the engagement between primary latch 126 and secondary latch 138 thereby causing operating mechanism 38 to move to the "tripped" position (e.g., as in FIG. 8), described below. Secondary latch 138 includes a latch surface generally shown at 139 that aligns with a corresponding primary latch surface to release primary latch 126. The interface between primary latch 126 and secondary latch 138 (i.e., between primary latch surface and secondary latch surface), and between cradle 210 and primary latch 126 is not affected when a force is applied to toggle handle 44 to change from the "off" position to the "on" position.

Referring now to FIG. 8, in the "tripped" condition, secondary latch 138 has been displaced (e.g., by a thermal magnetic trip unit not shown) when secondary latch 138 pivots clockwise about a trip lever pin 140, and the interface between primary latch 126 and secondary latch 138 is released, best seen with reference to FIG. 6. The primary latch 126 is disengaged from cradle latch surface 164 (e.g., by rotating clockwise), and cradle 210 is rotated clockwise about cradle pivot pin 300. The movement of cradle 210 transmits a force to crank 208 (i.e., via at least one link 211 and 212 and a corresponding rivet), causing crank 208 to rotate counter clockwise about center 78 and drive cross pin 40 to an upper portion of the arcuate passage 52 configured in the cassette. The forces transmitted through cross pin 40 to rotary contact assembly 56 via opening 52 cause movable contacts 72, 74 to separate from stationary contacts 64, 66 (See FIGS. 5 and 6).

Referring to FIGS. 7 and 8, an assembly 272 of an interface mechanism 274, the bell alarm switch 26 and the cradle 210 is shown in the activated position and the inactivated position, respectively. The cradle 210 pivots with respect to cradle pivot pin 300 which includes a first link 302 operatively connected thereto. First link 302 pivots in a same direction with respect to cradle 210 about cradle pivot pin 300. Cradle pivot pin 300 is preferably configured as a D-pin on at least surfaces having contact with cradle 210 and first link 302 to prevent rotation of cradle 210 relative to first link 302, and vice versa. However, it will be recognized by one skilled in the pertinent art that other configurations are possible to prevent such rotation with respect to cradle pivot pin 300. In this manner, pivotal movement of cradle 210 results in corresponding pivotal movement of first link 302, and vice versa.

First link 302 in turn is in operable communication with a second link shown generally at 312 that is pivotally mounted to the adjacent cassette 36 via a second pin 314. In an exemplary embodiment with reference to FIGS. 2 and 7, second pin 314 includes one of the two positioning rods 31, such that second link 312 pivots about positioning rod 31 disposed between each cassette 32, 34, 36. Second link 312 includes a second arm 316 depending at one end from link 312 while an opposite end is in operable communication with an end surface of plunger 266 defining plunger 266. Plunger 266 is preferably biased toward first link 302 providing a bias on second arm 316 to bias second link 312 to pivot in a counter clockwise direction indicated by arrow 320 around pin 314. The bias of second link in the direction indicated by arrow 320 causes first link 302 to be biased in a clockwise direction indicated by arrow 321 via second arm 316, which causes cradle pivot pin 300 to be urged in a clockwise direction. In this manner, the bias on cradle pivot pin 300 is in the same clockwise direction that a bias on cradle 210 and crank 208 transmits to the pair of contacts in the "on" position. The interaction between the operating mechanism 38 (FIG. 2), cradle 210, first and second links 302, 312, and switch 26 will be detailed hereinafter.

Figure 9:
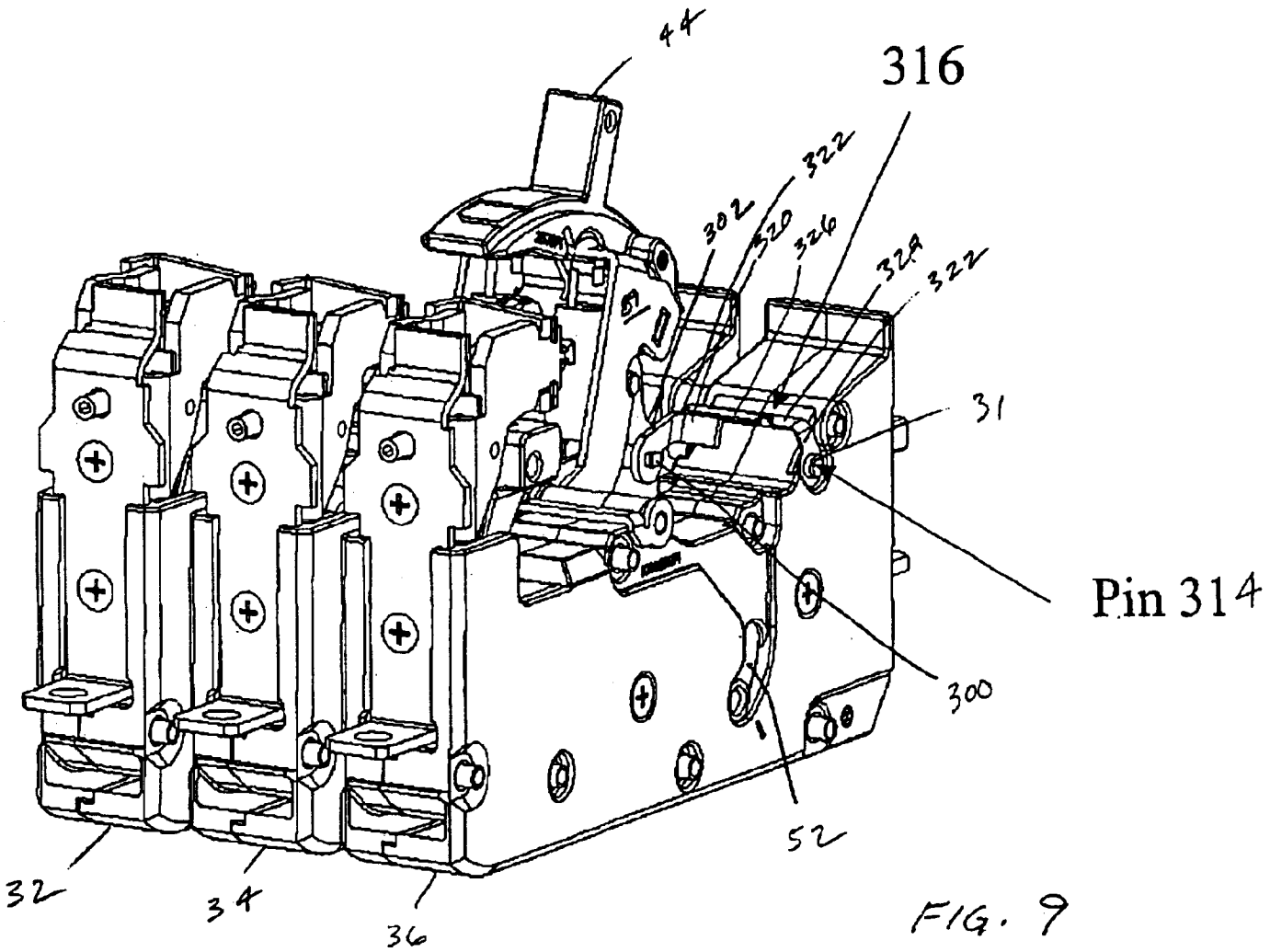
FIG. 9 is a side perspective view of the circuit breaker of FIGS. 7 and 8 detailing an exemplary embodiment of an interface mechanism for changing a state of the auxiliary switch.

The counter clockwise rotation of cradle 210 as to reset the assembly after a trip (described further herein) will accordingly transmit motion simultaneously through the cradle pivot pin 300, first link 302, second link 312, second arm 316 and switch 26 via plunger 266. More specifically, as the breaker mechanism is placed in the reset position illustrated in FIG. 7, cradle 210, which is fixedly attached to the cradle pivot pin 300, is rotated counter clockwise and engages and rotates first link 302 which is also fixedly attached to cradle pivot pin 300. As first link rotates counter clockwise, first link 302 engages second link 312 which in turn urges the second arm 316 portion of second link 312 to depress an end of plunger 266 of the switch 26 in an upward direction as illustrated (shown in phantom), thus actuating the bell alarm switch Referring now to FIG. 9, a side perspective view of an exemplary embodiment of first and second links 302, 312 are illustrated with respect to cassette 36. First link 302 is shown operably connected to operating mechanism 38 via D-pin 300 or cradle pin 300. First link 302 includes a flange 320 extending therefrom and extending across a portion of the width defining cassette 36. Flange 320 is configured to engage second arm 316 of second link 312. Second link 312 is configured substantially as a U-shaped link having outboard ends 322 defining sides thereof traversing a width of cassette 36 having second arm 316 therebetween. Outboard ends 322 pivotally mount about position rod 31 extending through cassettes 32, 34, 36 acting also as second pin 314 about which link 312 pivots.

Second arm 316 includes a compliant member 326 extending between outboard ends 322 and configured forming an obtuse angle between surfaces defining compliant member 326. The obtuse angle between surfaces is configured to operably engage flange 320 during pivotal movement thereof to change a state of bell alarm switch 26 via engagement with a surface 328 forming one surface of compliant member 326.

Referring to FIGS. 7 and 8, the operation and movement of the mechanical bell alarm assembly as utilized with the operating mechanism 38 will now be detailed. The mechanical bell alarm assembly (assembly) 272 is employed to provide indication when the operating mechanism 38 is discharged as is the case when the circuit breaker 10 (FIG. 8) is in the tripped condition.

FIG. 7 shows the assembly 272 when in the activated position. The activated position is when the circuit breaker 10 (FIG. 1) is in the latched position (charged). The circuit breaker 10 is charged when the operating mechanism 38 is as shown in FIGS. 4 and 5. FIG. 8 shows the assembly 272 and the operating mechanism 38 when in the inactivated position such as when a trip condition occurs. The circuit breaker 10 is discharged when the operating mechanism 38 is as shown in FIG. 6. From the description of the operating mechanism 38 as detailed hereinabove with reference to FIGS. 4–6, the cradle 210 remains in the position as shown in FIGS. 4, 5, and 7. Thus, the bell alarm assembly 272 remains in the activated position until the circuit breaker 10 is in the unlatched position (discharged).

Thus, after the circuit breaker 10 is reset and is "ON", the plunger 266 (shown in phantom) on the switch 26 is latched such that the surface 164 of the cradle 210 is in contact with the surface of the primary latch 126. Also, the second arm 316 of second link is in contact with, and applying a counterclockwise torque, about the pin 314 against first link 302 producing a clockwise torque applied thereto by the force of the spring loaded plunger 266 applied against the second arm 316. Further, the second arm 316 of second link 312 is pressingly engaged against the plunger 266 of the switch 26 such that the plunger 266 is fully depressed and the contacts within the switch 26 are closed. This is the condition of quiescent operation of the circuit breaker 10, wherein the cradle 210 is engaged with primary latch 126 and locked from further clockwise rotation about cradle pivot pin 300, the second arm 316, via the second link 312 engages with the first link 302, fully engages the plunger 266 of the switch 26 maintaining the plunger 266 in a loaded or retracted position. The assembly 272 is in the "activated" position.

When the circuit breaker 10 is tripped, for example due to an overcurrent condition or a mechanical trip (e.g., via a push-to-trip button), toggle handle 44 is between the "ON" position and the "OFF" position. Upon the occurrence of such an overcurrent condition and simultaneous articulation of the operating mechanism 38 to separate the contacts, the assembly 272 is inactivated consistent with the circuit breaker 10 being in the uncharged state. The inactivation of the switch 26 whereby the plunger 266 is released to a protruded position, as shown in FIG. 8, provides an indication to a remote operator, for example, that such a tripped condition has occurred and that the operating mechanism 38 has responded to interrupt the circuit current.

In order to reengage the operating mechanism 38 to the "ON" position, so as to return to quiescent condition, both operating mechanism 38 and assembly 272, or more particularly, the switch 26 must be reset.

Before toggle handle 44 may be returned to the quiescent operation position, i.e., "ON", circuit breaker operating mechanism 38 must be reset. This is accomplished by manually rotating toggle handle 44 in the counter-clockwise direction against the forces of one or more springs (not shown), thereby resetting latch 138 of operating mechanism 38 from the "Tripped" position (FIG. 8) to the "Latched" position (FIG. 7).

It is understood that the assembly 272 remains in the activated position until the operating mechanism 38 is discharged. The movement of the operating mechanism 38 from the discharged position (tripped position) to the charged position and the movement of the assembly 272 from the inactivated position to the activated position will now be described with reference to again FIGS. 7 and 8.

When it is desired to charge the operating mechanism 38, the cradle 210 is rotated counter-clockwise about cradle pivot pin 300, for example, by a motor control unit, manual operation of the toggle handle 44 or remote operating device.

Cradle pivot pin 300 is in operable communication with first link 302 that is pivotally mounted to at least one side frame 86 via cradle pin 300. First link 302 includes an opening 306 configured to receive cradle pivot pin 300 while preventing rotation of each relative to one another. A contact member 308 depends from link 302 for operable communication with second link 312.

Contact member 308 pivots about pin 300 in tandem without slippage because of the complementary "D" fitting between pin 300 and first link 302. Contact member 308 in turn is in operable communication with second link 312 that is pivotally mounted to at least one side frame 86 via second pin 314.

Second arm 316 depending at one end from link 312 while an opposite end is in operable communication with an end surface of plunger 266 defining plunger 266. Plunger 266 is preferably biased toward first link 302 providing a bias on second arm 316 to bias second link 312 to pivot in a counter clockwise direction indicated by arrow 320 around pin 314. The bias of second link in the direction indicated by arrow 320 causes first link 302 to be biased in a counter-clockwise direction indicated by arrow 321, which urges cradle pivot pin 300 to rotate clockwise. In this manner, the bias on cradle pivot pin 300 is in the same clockwise direction that a bias on cradle 210 and crank 208 urges the pair of contacts in the "on" position.

Still referring to FIGS. 7 and 8, operation of an exemplary embodiment of a bell alarm switch interface mechanism will be described shown generally at 272. FIG. 8 depicts the breaker contacts in the open or "tripped" position. As discussed above, FIGS. 7 and 8 also illustrate switch 26 shown in the activated position and the inactivated position, respectively, via translation of plunger 266. The interface mechanism 272 includes a set of linkages comprising cradle pivot pin 300, first link 302, and second link 312 in mechanical cooperation with each other and with cradle 210 via cradle pivot pin 300 and plunger 266 of switch 26 to change the state of switch 26. However, it is contemplated that cradle pivot pin 300 may be in mechanical cooperation with operating mechanism 38 via other means for such cooperation to receive energy mechanical energy therefrom other than via cradle 210.

FIG. 7 depicts the closed or, "reset" position when the contacts are closed and the switch 26 biases plunger 266 away therefrom to indicate a first state. The first state in this embodiment is indicative of the "reset" position and switch 26 is considered activated. When switch 26 and interface mechanism 272 are employed together a mechanical bell alarm assembly (assembly) 274 results, for example. Assembly 274 is employed to provide indication when the operating mechanism 38 is discharged as is the case when the circuit breaker 10 (FIGS. 1 and 8) is in the tripped condition and switch 26 is considered inactivated.

In operation, as the breaker contacts begin to open from the closed position depicted in FIG. 7 resulting from an overload or push-to-trip, primary latch releases cradle 210, and cradle 210 along with cradle pivot pin 300 rotate clockwise indicated by direction arrow 321 which allows a bias acting on plunger 266, as a result of stored energy thereon, to rotate second link 312 via second arm 316 and rotate second link 312 in a counter clockwise direction indicated by arrow 320 in FIG. 7. When second link 312 turns counter clockwise shown by arrow 320, second arm 316 extending from second link 312 also turns counter clockwise and allows plunger 266 from switch 26 to translate to a protruded position. When plunger 266 illustrated in FIG. 8 is in the protruded position, switch 26 changes state, such that the first state is changed to a second state indicative that the circuit breaker contacts are no longer closed.

Second arm 316 as shown in FIGS. 7 and 8 is configured as a stepped or offset compliant member, such that one side of the offset is in mechanical cooperation with contact member 308 of first link 302 while an opposite side of the offset is in mechanical cooperation with the end of the plunger 266. The size of the offset in second arm 316 is configured based on the distances between plunger 266, second link 312, and pivot pin 314, as well as the angle created therebetween.

Second arm 316 is preferably configured as a compliant member such that it allows flexible motion to "take up" variable gaps to compensate for any over travel resulting from possible tolerance variations of the interface mechanism or variations in actuation stroke of the plunger 266. More specifically, the compliant member is configured to flex providing "take up" for any over-travel as a result of positional variations at an interface of the bell alarm switch and the circuit breaker operating mechanism due to manufacturing tolerances, assembly tolerances, bell alarm switch installation, or extreme variations in actuation stroke of the plunger. The second link 312, and in particular the second arm 316, is employed to provide mechanical cooperation between the interfaced members, (the cradle 210 and switch 26), while adding compliancy to absorb forces in excess of those required to change the state of the switch 26.

In an exemplary embodiment, second arm 316 is preferably fabricated as a thin strip of stainless steel that is designed to flex when the force to operate the switch or switch is exceeded, providing the "take-up" for any remaining over-travel as a result of variations due to part and assembly tolerances and switch installation. However, other suitable materials are contemplated that provide the required "take up" and is not limited to stainless steel.

A compliant member, and in particular the second arm 316, is employed to provide mechanical cooperation between the interfaced members, (the crank 208 and the switch 26), while adding compliancy to absorb forces in excess of those required to reset the switch 26.

It will also be recognized by one skilled in the pertinent art that the first link 302 and the second link 312 are pivotally disposed such that the switch 26 uses energy from the operating mechanism in moving the pair of contacts from the "on" to "off" position. In this manner, robbing energy from the operating mechanism during the critical "tripping" operation that is typical in conventional systems is avoided. The above described interface mechanism 272 employs energy from the operating mechanism and stores the same during the less critical trip to reset operation.

Thus, interface mechanism 272 disposable between the circuit breaker and internal accessories is provided which easily provides actuation of a variably configured bell alarm switch when the circuit breaker changes state in an overload "trip" condition. The interface mechanism stores energy from the operating mechanism when resetting the circuit breaker, thereby using only the stored energy during resetting and releasing the same during a trip event, without robbing the operating mechanism of any energy during this critical "tripping" operation. In fact, the released stored energy during a trip event from the interface mechanism may even aid the operating mechanism during a trip. Switch 26 is easily installed and is contained within the space available within the mid cover 20. The relevant UL requirement allows the customer to remove the top cover 14 (FIG. 2) and install the accessories since the operating mechanism and all other exposed metal parts are electrically isolated from the live parts within the cassettes. Also, the end user can easily utilize the interface mechanism 272 with the switch 26 that is easily engaged within the mid cover 20. Additionally, any manufacturing variances as to the precise location of the switch 26 or variably dimensioned accessories 26 within mid cover 20 and relative to the cradle 210 of the operating mechanism 38 are tolerated, as are field or installation imperfections that may jolt or otherwise shift the locations of the switch 26 relative to the cradle 210. The interface mechanism 272 has the ability to compensate for manufacturing tolerances to ensure that the switch 26 provides accurate status indications of the operating mechanism 38 through the set of linkages employed in the interface mechanism 272.

While the invention. has been described with reference to a preferred embodiment, it will be understood by those skilled in the art that various changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly for interacting with an operating mechanism of a circuit breaker, the circuit breaker including a housing and a pair of contacts within the housing, the operating mechanism arranged to separate the pair of contacts upon actuation thereof, the assembly comprising:

an accessory device disposed in the housing including a plunger configured for movement between a retracted position and a protruded position;

a cradle pivot pin having operable communication with the operating mechanism;

a first link in mechanical cooperation with said cradle pivot pin, said first link and said cradle pivot pin being complimentary configured such that said first link receives said cradle pivot pin therein and rotation relative to each other is prevented; and a second link in mechanical cooperation with said first link and said plunger, wherein the operating mechanism applies a force to said cradle pivot pin during a trip condition, the force changing a state of said accessory device by being transmitted from the operating mechanism to said cradle pivot pin, from said cradle pivot pin to said first link, from said first link to said second link, from said second link to said plunger for changing a position of said plunger from one of said protruded position and said retracted position.

2. The assembly of claim 1 wherein said first link includes a first lever rotatable about a first pivot, said lever having a first free end, said first free end configured for mechanical cooperation with said second link.

3. The assembly of claim 1 wherein said accessory device is a bell alarm switch.

4. The assembly of claim 1 wherein said second link includes a second lever rotatable about a pivot, said second lever being a compliant member configured for interacting with said first link and said plunger.

5. The assembly of claim 4 wherein said compliant member is configured to flex providing "take up" for any over-travel as a result of positional variations at an interface of the accessory device and the circuit breaker operating mechanism due to one of manufacturing tolerances, assembly tolerances, accessory device installation, and extreme variations in actuation stroke of said plunger.

6. The assembly of claim 4 wherein said compliant member is a thin strip of stainless steel.

7. The assembly of claim 4 wherein said compliant member is configured having an offset intermediate therein, one side of said offset in mechanical cooperation with said first link while another side of said offset opposite said one side is in mechanical cooperation with said plunger.

8. The assembly of claim 1 wherein said first link and said second link are pivotally disposed such that the accessory device uses energy from the operating mechanism in moving the pair of contacts from the "on" to "off" position.

9. The assembly of claim 1 wherein said second link is configured to flex providing "take up" for any remaining over-travel during resetting of the operating mechanism as a result of positional variations at an interface of the accessory device and the circuit breaker operating mechanism due to one of manufacturing tolerances, assembly tolerances, accessory device installation, and extreme variations in actuation stroke of said plunger.

10. The assembly of claim 1 wherein said cradle pivot pin is operably connected to a cradle operably connected to the operating mechanism, said cradle configured to receive said cradle pivot pin therein and prevent rotation relative to each other.

11. The assembly of claim 10 wherein said cradle is in operable communication with a latch assembly, said latch assembly configured to control pivotal movement of said cradle about said cradle pivot pin.

12. A circuit breaker comprising:

a housing;

a pair of electrical contacts within said housing;

an operating mechanism arranged to separate said pair of electrical contacts;

an accessory device disposed in the housing including a plunger configured for movement between a retracted position and a protruded position;

a cradle pivot pin having operable communication with the operating mechanism;

a first link in mechanical cooperation with said cradle pivot pin, said first link and said cradle pivot pin being complimentary configured such that said first link receives said cradle pivot pin therein and rotation relative to each other is prevented; and a second link in mechanical cooperation with said first link and said plunger, wherein the operating mechanism applies a force to said cradle pivot pin during a trip condition, the force changing a state of said accessory device by being transmitted from the operating mechanism to said cradle pivot pin, from said cradle pivot pin to said first link, from said first link to said second link, from said second link to said plunger for changing a position of said plunger from one of said protruded position and said retracted position.

13. The circuit breaker of claim 12 wherein said first link includes a first lever rotatable about a first pivot, said lever having a first free end, said first free end configured for mechanical cooperation with said second link.

14. The circuit breaker assembly of claim 12 wherein said accessory device is a bell alarm switch.

15. The circuit breaker of claim 12 wherein said second link includes a second lever rotatable about a pivot, said second lever being a compliant member configured for interacting with said first link and said plunger.

16. The circuit breaker of claim 15 wherein said compliant member is configured to flex providing "take up" for any over-travel as a result of positional variations at an interface of the accessory device and the circuit breaker operating mechanism due to one of manufacturing tolerances, assembly tolerances, accessory device installation, and extreme variations in actuation stroke of said plunger.

17. The circuit breaker of claim 15 wherein said compliant member is a thin strip of stainless steel.

18. The circuit breaker of claim 15 wherein said compliant member is configured having an offset intermediate therein, one side of said offset in mechanical cooperation with said first link while another side of said offset opposite said one side is in mechanical cooperation with said plunger.

19. The circuit breaker of claim 12 wherein said first link and said second link are pivotally disposed such that the accessory device uses energy from the operating mechanism in moving the pair of contacts from the "on" to "off" position.

20. The circuit breaker of claim 12 wherein said second link is configured to flex providing "take up" for any remaining over-travel during resetting of the operating mechanism as a result of positional variations at an interface of the accessory device and the circuit breaker operating mechanism due to one of manufacturing tolerances, assembly tolerances, accessory device installation, and extreme variations in actuation stroke of said plunger.

21. The circuit breaker of claim 12 wherein said cradle pivot pin is operably connected to a cradle operably connected to the operating mechanism, said cradle configured to receive said cradle pivot pin therein and prevent rotation relative to each other.

22. The circuit breaker of claim 21 wherein said cradle is in operable communication with a latch assembly, said latch assembly configured to control pivotal movement of said cradle about said cradle pivot pin.

23. An assembly for interacting with an operating mechanism of a circuit breaker, the circuit breaker including a housing and a pair of contacts within the housing, the operating mechanism arranged to separate the pair of contacts upon actuation thereof, the assembly comprising:

an accessory device disposed in the housing including a plunger configured for movement between a retracted position and a protruded position;

a means for receiving rotational mechanical energy from the operating mechanism upon movement of the pair of contacts;

a cradle pivot pin configured to receive said means for receiving rotational mechanical energy from the operating mechanism upon movement of the pair of contacts;

a first link in mechanical cooperation with said cradle pivot pin, said first link and said cradle pivot pin being complimentary configured such that said first link receives said cradle pivot pin therein and rotation relative to each other is prevented; and a second link in mechanical cooperation with said first link and said plunger, wherein the operating mechanism applies a force to said cradle pivot pin during a trip condition, the force changing a state of said accessory device by being transmitted from the operating mechanism to said cradle pivot pin, from said cradle pivot pin to said first link, from said first link to said second link, from said second link to said plunger for changing a position of said plunger from one of said protruded position and said retracted position.

* * * * *

UNITED STATES PATENT AND TRADEMARK OFFICE

CERTIFICATE OF CORRECTION

PATENT NO. : 6,778,048 B1
APPLICATION NO. : 10/249860
DATED : August 17, 2004
INVENTOR(S) : Luis Brignoni et al.

It is certified that error appears in the above-identified patent and that said Letters Patent is hereby corrected as shown below:

Column 2,
Line 44, after "auxiliary", delete ",".

Column 5,
Line 7, after "must", delete "-".

Column 7,
Line 2, after "switch", insert therefor —26.--.

Column 10,
Line 52, after "invention", delete ".".

Signed and Sealed this

Twenty-second Day of August, 2006

JON W. DUDAS
*Director of the United States Patent and Trademark Office*